United States Patent [19]

Herrington et al.

[11] Patent Number: 4,791,843

[45] Date of Patent: Dec. 20, 1988

[54] BULLET PUNCH

[75] Inventors: Fox J. Herrington, Holcomb; Richard A. Holland, Canandaigua, both of N.Y.

[73] Assignee: Mobil Oil Corporation, New York, N.Y.

[21] Appl. No.: 115,324

[22] Filed: Nov. 2, 1987

[51] Int. Cl.[4] ..... B26D 5/12; B26D 7/18

[52] U.S. Cl. ..... 83/100; 83/575; 83/639; 83/687

[58] Field of Search ..... 83/100, 575, 639, 98, 83/686, 687

[56] References Cited

U.S. PATENT DOCUMENTS

| | | | |
|---|---|---|---|
| 2,302,646 | 11/1942 | Temple . | |
| 2,853,133 | 9/1958 | Norman et al. . | |
| 2,924,147 | 2/1960 | Bohl et al. | 89/1 |
| 3,134,422 | 5/1964 | Granberg . | |
| 3,156,148 | 11/1964 | Carr | 83/34 |
| 3,260,445 | 7/1966 | Wiseman, Jr. | 83/575 |
| 3,476,043 | 11/1969 | Erdley | 83/575 |
| 3,580,120 | 5/1971 | Adams et al. | 83/98 |
| 3,779,121 | 12/1973 | Lagain | 83/614 |
| 4,030,391 | 6/1977 | Swanson et al. | 83/137 |
| 4,130,041 | 12/1978 | McGee | 83/617 |
| 4,471,680 | 9/1984 | Gerhart | 83/588 |

*Primary Examiner*—Frank T. Yost
*Assistant Examiner*—Eugenia A. Jones
*Attorney, Agent, or Firm*—Alexander J. McKillop; Michael G. Gilman; Charles J. Speciale

[57] ABSTRACT

An apparatus for punching holes into sheet materials, and more particularly, a high speed punching apparatus of the so-called bullet punch type for the sequential punching of holes into an advancing web or sheet of paper, plastic or other film material through the intermediary of a high-speed projectile reciprocatively piercing through the material.

5 Claims, 2 Drawing Sheets

BULLET PUNCH

BACKGROUND OF THE INVENTION

1. Field of the Invention

The present invention relates to an apparatus for punching holes into sheet materials, and more particularly, relates to a high speed punching apparatus of the so-called bullet punch type for the sequential punching of holes into an advancing web or sheet of paper, plastic or other film material through the intermediary of a high-speed projectile reciprocatively piercing through the material.

In the production of various kinds of articles which are constituted from either sheets of paper, paperboard or plastic film webs, there is frequently a need to punch a plurality of accurately located holes in the material. Quite often, in mass-production technologies, the sheet or web of film material is advanced at relatively high speeds so as to necessitate the employment use of rapidly operating, and generally highly sophisticated hole punching equipment for accurately correlating the hole punching sequences with the advance of the sheet or film material. More recently, advances in production techniques have necessitated the use of hole punching apparatus which must operate at ever higher punching speeds, while maintaining a tenable degree of precision, resulting in the need for frequent replacements of the cutting implements or knives of the hole punches due to dulling or wear by new or resharpened knives or cutting implements. This requirement is not only expensive from the viewpoint of having constantly supply new or replacement knives or cutting implements, but also necessitates considerable expenditure of labor and "downtime" for servicing the entire production facility, resulting in appreciable financial expenditures which frequently renders the operation less economical.

2. Discussion of the Prior Art

Heretofore, the major types of hole punching systems and methods employed in industry for the punching of holes into sheets or film web materials were, in one instance, of the so-called ball punch type, providing for a stationary ball and a cooperating movable knife which strikes against a film as the latter is conveyed between the ball and knife, so as to form a cutout or hole in the film. This results in the rapid wear of the cutting surfaces or edges of the knife, and as a consequence necessitating the frequent replacement of the knife. Another hole punching system contemplates the use of a rotating knife which essentially drills through the film or sheet material, thereby also causing the extremely rapid wear of the cutting edges of the knife. A further arrangement provides for a punch, or knife, which is received within a complementary die and then returned to its initial set position subsequent to punching the hole in the material. Another system, which is similar to the above-mentioned punching die, provides for a knife in the form of a hollow serrated tube having a cutting edge piercing the film material and then engaging into an opening provided in a die. Finally, still another system employed in industry provides for a so-called shearing of the material, in which the holes in the sheet for film web are punched out by either a knife passing over the film while cutting the latter, or in which a knife is embedded in a grooved roll and the film web is cut when it is conveyed between the bed for the knife which is formed in the surface of the roll and the cutting edge of the knife. Practically all presently employed hole punching systems are, to a greater or lesser extent, based on the above-mentioned concepts.

In all of the aforementioned hole punching systems, in addition to the necessity for providing rather complex and expensive apparatus, the advancing web must be stopped during the punching sequence in order to be able to allow for the formation of accurately sized holes in the material. This not only slows down the advance of the film web or sheet material, but also requires complex devices for synchronizing the resultingly intermittent advance of the film web with the punching of the holes by the hole punching apparatus.

Consequently, in order to considerably reduce the wear on the cutting edge of the knife or punch which is employed in forming the holes in the sheet or film web material, there has more recently been developed the concept of a so-called "bullet punch", in which a projectile-shaped cutting body possessing cutting edges or knives at opposite ends thereof, is propelled at high speeds between two end positions on opposite surfaces of an advancing film web or sheet being passed between the positions, and in which the knives pierce through the film web as the projectile is propelled therethrough so as to cause the opposite knife edges to alternatingly form sequential holes in the advancing sheet or film web material. This will clearly result in a reduced wear of the knife edges while allowing for a rapid advance of the sheet or film web in a practically continuous manner.

Carr U.S. Pat. No. 3,156,148 discloses a data processing card punching apparatus and hole punching method, in which a closed loop-shaped conduit is connected to a source of pressurized air, and incorporates a conduit section having a gap cut transversely therethrough for the passage of data processing cards across the conduit section. A projectile having cutting blades at each end thereof adapted to punch holes through the cards is reciprocated within the conduit section in response to pressurized air being alternatingly applied to opposite ends of the projectile, thereby causing the latter to be propelled from one end of the conduit section towards the other end, and back again. This will cause the projectile, during each displacement thereof, to pierce data processing cards sequentially interposed in the gap formed in the conduit section, and with material chips punched out of the data cards by the projectile to drop out through suitable apertures formed in the conduit section. Although this particular structure allows for a higher operating speed during the punching of holes in sequentially advanced data processing cards, while reducing wear on the cutting blades, quite frequently punched out card chips will tend to clog up within the conduit section. Moreover, there is no accurate control over the advancing speed and reciprocating motion of the projectile, thereby rendering the entire operation somewhat inaccurate and uneconomical for use with continuously advancing webs of material.

Bohl, et al. U.S. Pat. No. 2,924,147 discloses a blast-free explosive line cutter in which a projectile is adapted to pierce through a rod member extending through a conduit so as to separate the rod member into separate rod sections. This patent does not disclose the concept of employing a reciprocating projectile or bullet punch employed in the punching of holes into a continuously advancing sheet or web of a film material.

Lagain U.S. Pat. No. 3,779,121 discloses a sheet metal cutting apparatus in which a projectile is adapted to be reciprocated back and forth within a tubular section under the action of fluid pressure alternatively applied to opposite ends of the projectile, and which includes an external cutting member adapted to slice through sheet members disposed therebeneath, in which opposite cutting edges thereon will alternatingly cut through sheet members as the cutting member reciprocates in conjunction with the movement of the projectile. This structure does not provide for the highly accurate bullet punch arrangement as contemplated by the present invention.

SUMMARY OF THE INVENTION

Accordingly, an object of the present invention contemplates the provision of an apparatus for the accurately timed, sequential punching of one or more holes into a continuously advancing sheet or web of a film material, which apparatus incorporates a projectile reciprocatably propelled at a high velocity between mutually facing spaced housings having recess with projectile-receiving openings, intermediate which the sheet or film material is conveyed past the openings, so as to cause the projectile to pierce at a high speed through the film web during propulsion of the former from the opening of one housing recess into the opening of the oppositely located housing recess under the action of a pressurized medium, such as compressed air, and wherein an alternating vacuum may be selectively applied to the openings in the housings to aspirate the material or chips punched out of the film web. Each of the housings may be provided with suitable periodically energized electromagnets adapted to magnetically attract and retain the projectile in position within the housing prior to being propelled through the film web into the opposite housing, and wherein the opposite housing becomes the vehicle for subsequently propelling the projectile in the opposite direction in order to punch a sequentially spaced hole in the advancing film web as it is returned to the first-mentioned housing.

Through an appropriate correlation in the timing between the energizing of electromagnets in the oppositely arranged housings, the actuation of the pressurized medium, such as the compressed air in the respective housing, and the aspiration of the material chips punched out by the projectile, and through the intermittently timed application of a vacuum, the projectile, which incorporates hole-punching cutting edges at the opposite ends thereof, is adapted to reciprocate in extremely rapid and highly accurate manner so as to punch precisely located and dimensioned sequential holes through the advancing sheet or film material, without the need for slowing down or stopping the advance of the material.

It is a more specific object of the present invention to provide a hole punching apparatus of the bullet punch type as described herein wherein a projectile is adapted to be propelled at high speeds between oppositely located projectile-receiving housings so as to be able to pass through and form accurately punched holes in a continuously advancing sheet or film web.

BRIEF DESCRIPTION OF THE DRAWINGS

The foregoing features and other objects and advantages of the invention may now be more readily ascertained from the following detailed description of an exemplary embodiment of the novel bullet punch, taken in conjunction with the accompanying drawings; in which.

DETAILED DESCRIPTION

Figure 1:
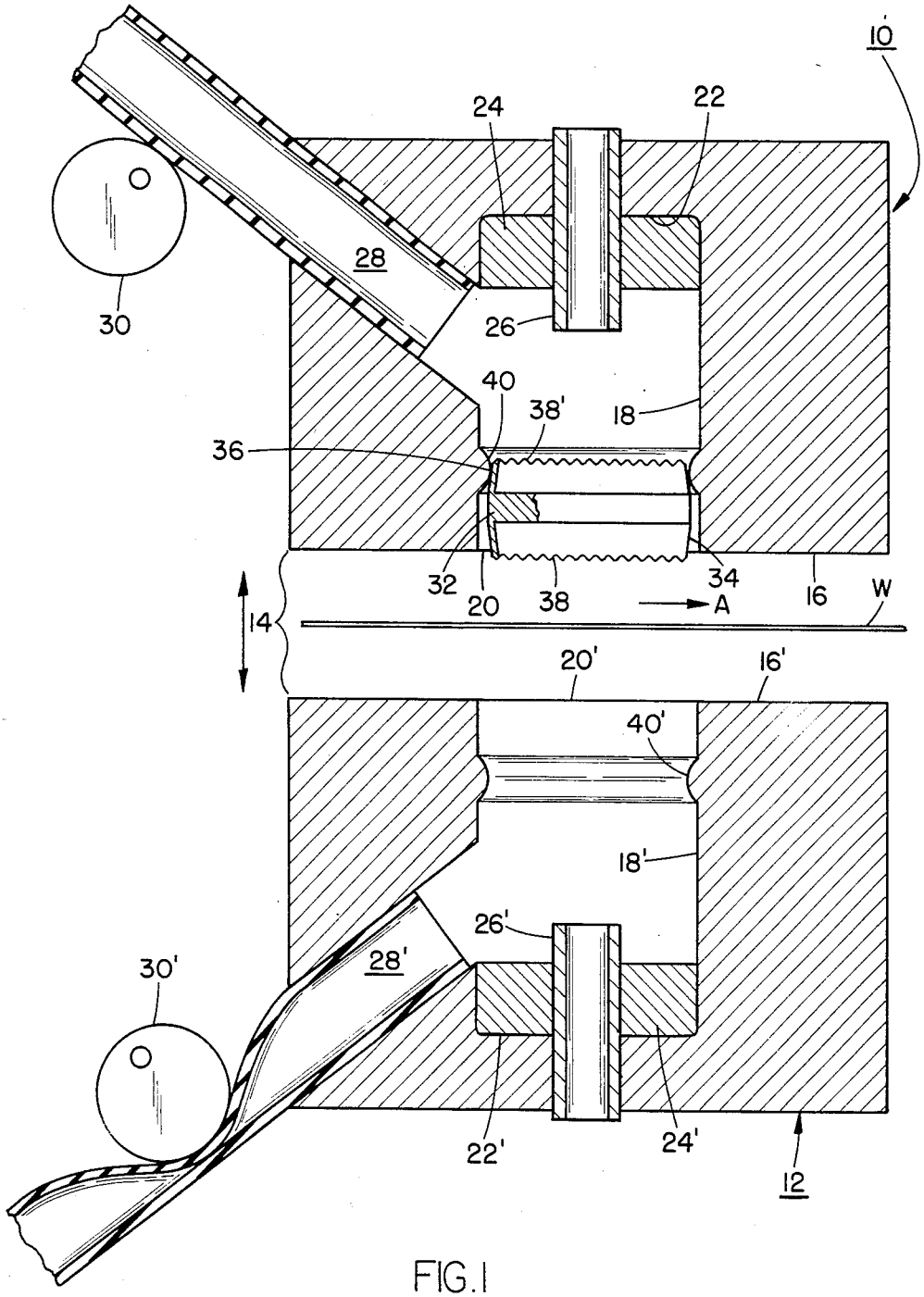
FIG. 1 illustrates, in a generally schematic representation, a sectional view through a hole punching apparatus pursuant to the invention.

Referring in particular to FIG. 1 of the drawings, the inventive hole punching apparatus, which is of the type generally referred to as a "bullet punch", includes a first housing 10 arranged at one side of a continuous sheet material or film web W advancing in the direction of arrow A, and a second similar housing 12 arranged opposite the housing 10 on the other side of the film web W. Both housings 10 and 12 are of essentially identical or similar constructions, and are arranged in a mirror-image opposite each other, so as to provide a gap 14 for the passage of the film web 10 between the facing surfaces 16 and 16' of the housings 10, 12.

The components in the housing 12 which are similar to or identical with those in housing 10 are identified with the same reference numerals but with the inclusion of the suffix "prime".

The housings 10, 12, respectively, each include a recess 18 and 18' in coaxial alignment, each having an opening 20, 20' in the surfaces 16, 16' facing towards the film web W. Although each recess 18, 18' is preferably of a cylindrical configuration so as to allow for the formation of round holes in the film web W, it is clearly apparent that other shapes for the recesses, such as oval, oblong or multi-faceted can be employed for the formation of correspondingly shaped holes. The bottom 22, 22' of each recess 18, 18' is provided with an electromagnet 24, 24' communicating with a suitable control device (not shown) supplying electrical energy for intermittently actuating the electromagnet 24, 24' in an operative sequence as described in further detail hereinbelow. Extending through each electromagnet 24, 24' is a conduit 26, 26' each having a discharge or opening communicating with the bottom of recess 18, 18', and which are each connected to a source (not shown) for intermittently supplying a pressurized medium, such as compressed air, in synchronous operation with the actuation of the electromagnets 24, 24'. The recesses 18, 18' each also communicate at their inner circumferential walls proximate the electromagnets 24, 24' with a further passageway 28, 28' connecting to a vacuum source (not shown) for intermittently and alternatingly applying a vacuum to each passageway 28, 28' during the operation of the hole punching apparatus. Suitable shut-off devices, such as cams 30, 30' or closure valves, may be arranged to selectively open or block vacuum lines leading from the vacuum source to the vacuum passageways 28, 28'.

The hole-forming bullet punch, which is essentially in the shape of a projectile 32, and which has a cross-sectional shape in conformance with the configuration of recesses 18, 18', is adapted to be axially reciprocated between the recesses 18, 18' in the housings 10 and 12. In essence, the projectile-shaped punch 32 is constituted of a substantially hollow barrel-shaped circumferential wall structure 34 tapering radially inwardly from the middle towards each axial end, so as to provide a maximum diameter or cross-section at the middle thereof which is closed off by a plate or disc-shaped member 36. The opposite annular ends of the projectile 32 include an annular or circumferentially extending cutting edge or knife structure 38, 38', for example, a serrated cutting edge, which is adapted to pierce through the advancing sheet or film web W as the projectile 32 is propelled at a high velocity from one recess 18 in the housing 10 into the other recess 18' of the oppositely located housing 12, and conversely. The extent of the entry of the projectile or bullet punch 32 into each recess 18, 18' is limited by an annular restriction 40, 40' in the circumferential wall structure of the recess 18, 18', such restriction being slightly smaller in cross-section or diameter than the cross-section or diameter of the plate or disc 36 of the projectile.

The operation of the hole punching apparatus or bullet punch pursuant to the present invention is substantially as follows; having particular reference to FIGS. 2 through 4 of the drawings:

A continuous sheet or web of a film material W, preferably constituted of either paper, paperboard or any suitable plastic material, is advanced through the gap 14 between the facing surface 16, 16' of the axially aligned housings 10 and 12 of the hole punching apparatus, such that a location on the advancing web W through which one or more holes is to be punched is positioned intermediate the openings 20, 20' of the cylindrical recesses 18, 18' in the respective housings 10 and 12. At that point in time, the projectile 32, which is preferably constituted of a magnetizable metallic material, is initially magnetically restrained against the annular restriction 40 within the recess 18 in the housing 10, as shown in FIG. 2, in that the electromagnet 24 is electrically actuated so as to exert a magnetotractive force on the projectile 32. Thereafter, the vacuum passageway 28 is closed off through the closing action of the cam 30 on the line connecting the former with the vacuum source, and a pressurized medium, is compressed air, is introduced through the conduit 26 into the recess 18 in the housing 10 so as to propel or "fire" the projectile or bullet punch 32 at a high speed downwardly into the cylindrical recess 18' in the oppositely located housing 12. This will cause the lower annular knife or cutting edge 38 to punch a hole through the film web W located below the opening 20 as the projectile 32 pierces rapidly downwardly therethrough. Concurrently, the electromagnet 24 in the housing 10 is deactivated at the instance of the application of the compressed air so as to release the magnetic hold on the projectile 32, while the electromagnet 24' in the housing 12 is activated so as to magnetically retain the projectile 32 in its lower position against restriction 40', as shown in FIG. 3, defining the end of the downward displacement of the projectile. Concurrently, the vacuum passageway 28' in the housing 12 is opened through activation of cam 30' so as to cause the punched out chip or web material separated from web W by the lower cutting edge 38 to be aspirated into the vacuum passageway 28' of the housing 12, for subsequent discharge and/or disposal.

Upon the downward displacement of the projectile 32 from the recess 18 in the housing 10 and its entry into recess 18' in housing 12, the flow of compressed air from the pressurized medium conduit 26 is housing 10 is terminated, with the downward movement of the projectile 32 being stopped by contact with the annular restriction 40' in the recess 18' in housing 12.

Figure 3:
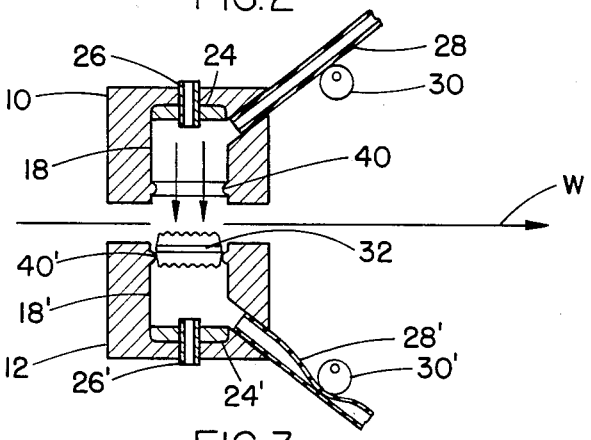
Figure 4:
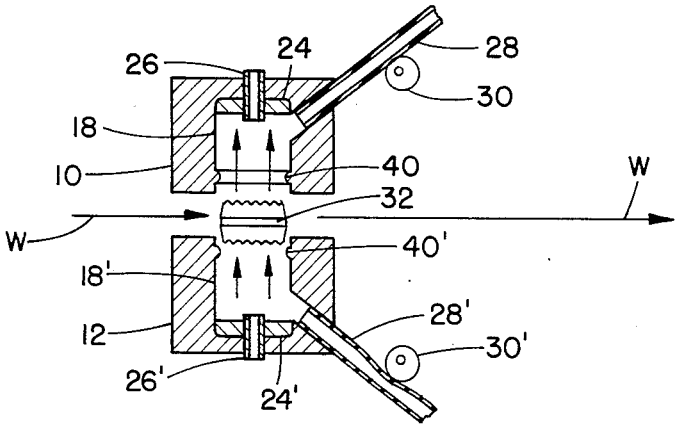

Almost immediately thereafter, as shown in FIG. 3, while the film web W is advancing, the electromagnetic 24' in the housing 12 is deactivated so as to enable release therefrom of the projectile 32 located in the recess 18', the electromagnet 24 in the housing 10 is activated, the vacuum passageway 28' in the housing 12 is shut off by operation of the cam 30', while the vacuum passageway 28 in the housing 10 is opened, and pressurized medium (compressed air) is introduced into recess 18' through the conduit 26' in the housing 12 so as to propel or "fire" the projectile 32 upwardly at a high speed through the film web W into the recess 18 of the housing 10; in effect, the reverse of the previous process, and causing the projectile to punch a subsequent hole in the film web W. The chip or material which is punched out from the film web W by the upper knife or cutting edge 38' is aspirated out through the vacuum passageway 28 in the housing 10, in a manner as previously described with regard to the functioning of the vacuum passageway 28' in the housing 12, and the projectile 32 is maintained in the uppermost position in contact against the restriction 40 in housing 10 by the magnetic attraction of the energized electromagnet 24 in the housing 10. This particular operating stage of the bullet punch is clearly shown in FIG. 4 of the drawings.

Figure 2:
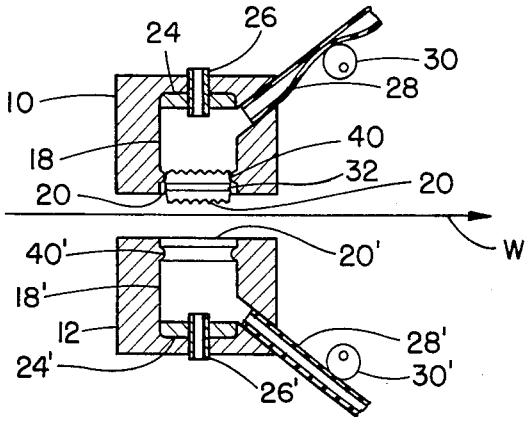
FIGS. 2 through 4 respectively illustrate, on a reduced scale, the operative sequence of the inventive hole punching apparatus.

Thereafter, the entire operating cycle is repeated, as described in conjunction with FIG. 2 of the drawings and the projectile 32 propelled back and forth between the recesses 18 and 18' in housings 10 and 12 so as to punch a continuous sequence of holes through the advancing film web W.

Although the apparatus and function thereof has been described with regard to a horizontally conveyed film web W, and with the housings 10 and 12 shown as being vertically oriented in coaxial alignment, it would be obvious to one skilled in the technology that the housings 10 and 12 may be horizontally oriented and the film web advanced either upwardly or downwardly in a vertical or inclined orientation relative to the horizontal.

From the foregoing, it becomes readily apparent that the bullet punch or hole punching apparatus pursuant to the invention is of an extremely simple and dependable construction, possessing a high speed in its operation in nature, enabling the projectile to be readily replaced by a similar projectile upon any wear of the cutting edges 38, 38' without necessitating any extensive stoppage or downtime for servicing of the apparatus.

While there has been shown and described what are considered to be preferred embodiments of the invention, it will of course be understood that various modifications and changes in form or detail could readily be made without departing from the spirit of the invention. It is therefore intended that the invention be not limited to the exact form and detail herein shown and described, nor to anything less than the whole of the invention herein disclosed as hereinafter claimed.

What is claimed is:

1. An apparatus for sequentially punching holes in an advancing continuous web of a film material; comprising a first housing including a recess having an open end facing towards one side of said film web; a second housing in coaxial alignment with said first housing, said second housing including a recess having an open end facing towards the opposite side of said film web, a narrow gap between the facing housings facilitating conveyance of said film web therebetween; a projectile being supported for movement in said recesses between said first and second housings and through the film web in said gap; cutting means at both ends of said projectile for punching holes into said film web upon passage therethrough; selectively energizable electromagnet means in each of said recesses for magnetically attracting said projectile; vacuum means communicating with the interior of each said recess for aspirating material punched out of said film web by said projectile; pneumatic means communicating with each said recess introducing a pressurized medium into said recess for rapidly propelling said projectile in a reciprocating motion between said recesses to cause said cutting means at each end of said projectile to alternatingly punch an accurately sized hole in said film web during rapid passage through said film web; means for energizing one of said electromagnet means for magnetically attracting said projectile in one end position in the recess in said first housing; means for concurrently applying a vacuum in said recess for aspirating material punched out by said projectile; said control means deenergizing said electromagnet means and releasing said vacuum upon a predetermined advance of said film web and for conducting said pressurized medium into said recess in said first housing for propelling said projectile through said film web into the recess in said second housing; said control means concurrently activating a vacuum communicating with the recess in said second housing for aspirating the material punched out of said film web, and activates the electromagnet means in the recess in said second housing for magnetically restraining said projectile in the end position therein.

2. An apparatus as claimed in claim 1, wherein said control means reverses the operating cycle of said apparatus upon a further predetermined advance of said film web so as to propel said projectile from said second housing through said film web into the recess in said first housing.

3. An apparatus as claimed in claim 1, wherein said projectile comprises a barrel-shaped member having annular cutting edges at the axially opposite ends of said member for piercing said film web and punching holes therein.

4. An apparatus as claimed in claim 1, wherein said projectile is constituted of a metallic material attractable to said electromagnet means upon electrical energizing of said electromagnet means.

5. An apparatus as claimed in claim 1, wherein said recesses in said first and second housings are cylindrical in cross-section, and said projectile is substantially cylindrical so as to punch round holes into said film web.

* * * * *